US008761623B2

(12) United States Patent
Wayman et al.

(10) Patent No.: US 8,761,623 B2
(45) Date of Patent: Jun. 24, 2014

(54) ACTIVE BANDING CORRECTION IN SEMI-CONDUCTIVE MAGNETIC BRUSH DEVELOPMENT

(75) Inventors: William H Wayman, Ontario, NY (US); John S Facci, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 448 days.

(21) Appl. No.: 13/151,314

(22) Filed: Jun. 2, 2011

(65) Prior Publication Data

US 2012/0308248 A1 Dec. 6, 2012

(51) Int. Cl.
*G03G 15/06* (2006.01)
*G03G 15/09* (2006.01)

(52) U.S. Cl.
USPC ..... 399/55; 399/270

(58) Field of Classification Search
USPC ..... 399/55, 270, 271, 37, 240
See application file for complete search history.

(56) References Cited

U.S. PATENT DOCUMENTS 5,539,505 A 7/1996 Parker
6,285,837 B1 9/2001 Budnik et al.
7,424,234 B2 * 9/2008 Kim et al. ..... 399/67

* cited by examiner

*Primary Examiner* — Billy Lactaoen

(57) ABSTRACT

An electronic development compensation method which is broadly applicable to SCMB development includes controlling image banding by actively correcting for mechanical development errors by modulating DC bias to a magnetic brush.

17 Claims, 7 Drawing Sheets

UNCORRECTED PRINT

CORRECTED PRINT

ACTIVE BANDING CORRECTION IN SEMI-CONDUCTIVE MAGNETIC BRUSH DEVELOPMENT

BACKGROUND

1. Field of the Disclosure

This application generally relates to printing, and in particular, eliminating banding in semi-conductive magnetic brush developed images.

2. Description of Related Art

Banding in printing systems has been and will continue to be an engineering challenge in xerographic marking engines based on semi-conductive magnetic brush (SCMB) development as shown, for example, in U.S. Pat. Nos. 5,539,505 and 6,285,837 B1. Image banding is an image quality defect that consists of halftone density variation in the process direction and manifests itself as light and dark bands in the cross-process direction. Banding is largely due to fluctuations in the photoreceptor (PR) drum to magnetic roll spacing resulting from photoreceptor and magnetic roll run-out. Mechanical variations in the development nip from photoreceptor and/or magnetic roll run-out can modulate the developer nip density (mass on roll) and hence developability resulting in banding. Banding is not always apparent at time-zero, but may manifest itself as the developer ages. Hence, other material state factors, such as: toner concentration/triboelectricity; toner age; and possibly material processing and flow properties. Material state factors may magnify the effect of even small initially acceptable variations in photoreceptor drum to magnetic roll spacing although they are not well understood.

Consequently, banding has been a very difficult problem to overcome and a method is needed to compensate for this effect other than costly mechanical countermeasures involving tightening of parts tolerances.

BRIEF SUMMARY

Accordingly, disclosed is an electronic development compensation method which is broadly applicable to SCMB development and comprises actively correcting for mechanical development errors by modulating the magnetic roll DC bias. Initially, the magnetic roll AC current is measured and filtered. Then, the low pass filtered current signal is amplified and AC coupled into a magnetic roll DC power supply error amplifier. A feedback circuit generates a time varying correction voltage that is applied to the DC bias on the developer power supply in phase with the AC current variation. All of these steps are accomplished in real-time with analog electronics.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
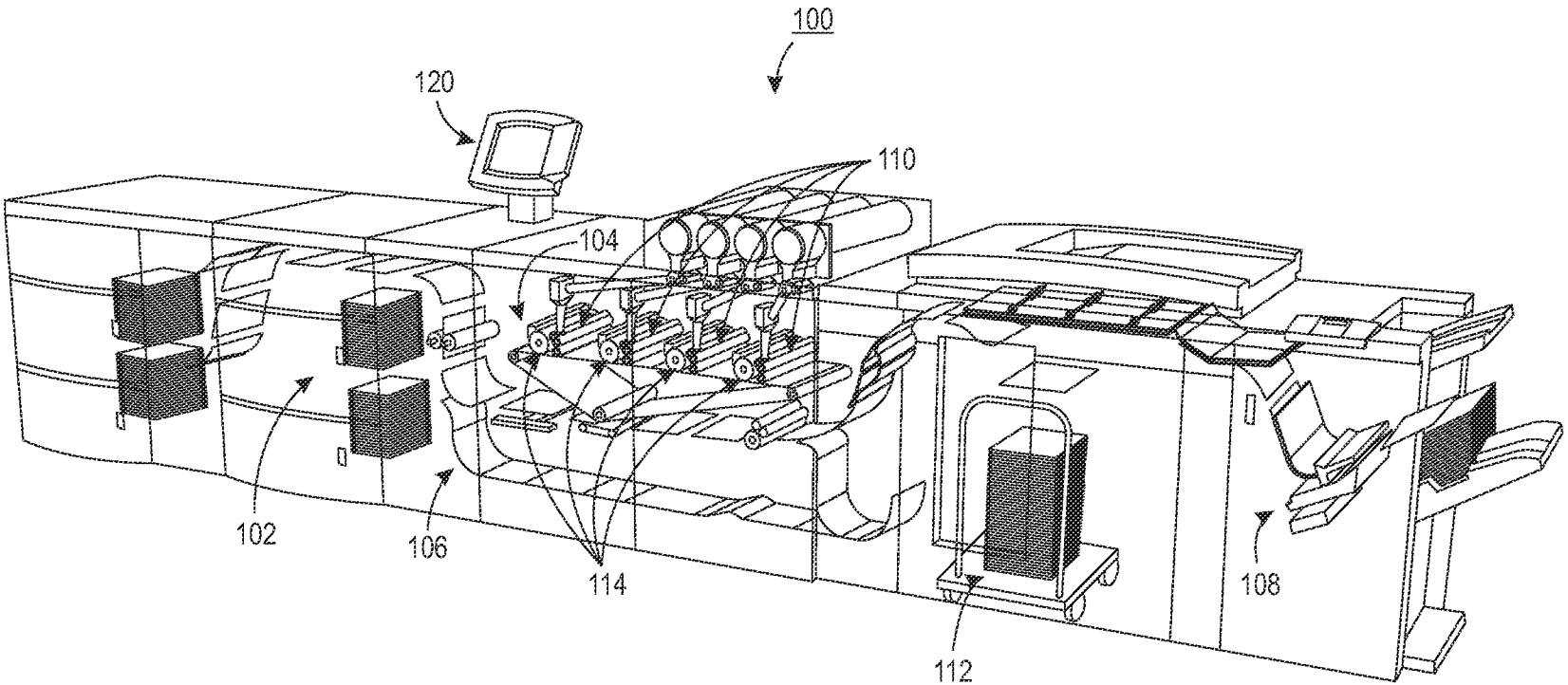
FIG. 1 shows a printer in accordance with an embodiment.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

For a general understanding of the features of the disclosure, reference is made to the drawings. In the drawings, like reference numerals have been used throughout to identify identical elements.

FIG. 1 shows a schematic illustration of a printer 100, in accordance with an embodiment. The printer 100 generally includes one or more sources of printable substrate media that are operatively connected to a printing engine 104, and output path 106 and finisher 108. As illustrated, the print engine 104 may be a multi-color engine having a plurality of imaging/development (SCMB) systems 110 that are suitable for producing individual color images. A stacker device 112 may also be provided as known in the art.

The print engine 104 may mark xerographically; however, it will be appreciated that other marking technologies may be used, for example by ink-jet marking, ionographically marking or the like. In one implementation, the printer 100 may be a Xerox Corporation DC8000™ Digital Press. For example, the print engine 104 may render toner images of input image data on a photoreceptor 114, where the photoreceptor 114 then transfers the images to a substrate.

A display device 120 may be provided to enable the user to control various aspects of the printing system 100, in accordance with the embodiments disclosed therein. The display device 120 may include a cathode ray tube, liquid crustal display, plasma, or other display device.

AC biases are employed in the SCMB development systems 110 in order to control developer conductivity and improve image quality (i.e., background). In accordance with the present disclosure, each of the developer systems include a developer nip positioned between a charge retentive substrate or photoreceptor 114 and a magnetic roll (not shown) and a real-time measurement of the AC current flowing through the development nip during a print cycle at the AC bias set-points (Vpp, frequency, duty cycle). In an ideal development nip, the AC current would be constant because the photoreceptor/magnetic roll spacing is constant. In real systems, the photoreceptor/magnetic roll spacing varies periodically because of photoreceptor and magnetic roll run-out and imperfect centering of the drives with respect to the center of the photoreceptor and magnetic roll. Envisioning the development nip, the AC (capacitive) current peaks when the photoreceptor/magnetic roll spacing is at a minimum and vice versa. Hence, the AC current follows the periodic variations in photoreceptor/magnetic roll spacing. Similarly, developability follows the variation in photoreceptor/magnetic roll spacing. Whether or not the AC current and developability are perfectly correlated is not known, however, experience has taught that the correlation is good enough that the AC current variations are useful for applying a correction to the DC magnetic bias to substantially mitigate banding. A magnetic bias applied to the developer stations at 110 can be used as a real-time "probe" of development nip density and/or mechanical errors. This mechanical error is actively corrected by modulating the magnetic roll DC bias.

AC biases are employed in the SCMB development systems 110 in order to control developer conductivity and improve image quality (i.e., background). In accordance with the present disclosure in FIGS. 1 and 7, each of the developer systems include a developer nip positioned between a charge retentive substrate or photoreceptor 114 and magnetic roll 115 and a real-time measurement of the AC current flowing through the development nip during a print cycle at the AC bias set-points (Vpp, frequency, duty cycle). In an ideal development nip, the AC current would be constant because the photoreceptor/magnetic roll spacing is constant. In real systems, the photoreceptor/magnetic roll spacing varies periodically because of photoreceptor and magnetic roll run-out and imperfect centering of the drives with respect to the center of the photoreceptor and magnetic roll. Envisioning the development nip, the AC (capacitive) current peaks when the photoreceptor/magnetic roll spacing is at a minimum and vice versa. Hence, the AC current follows the periodic variations in photoreceptor/magnetic roll spacing. Similarly, developability follows the variation in photoreceptor/magnetic roll spacing. Whether or not the AC current and developability are perfectly correlated is not known, however, experience has taught that the correlation is good enough that the AC current variations are useful for applying a correction to the DC magnetic bias to substantially mitigate banding. The bias applied to the developer stations at 110 can be used as a real-time "probe" of development nip density and/or mechanical errors. This mechanical error is actively corrected by modulating the magnetic roll DC bias.

Figure 7:
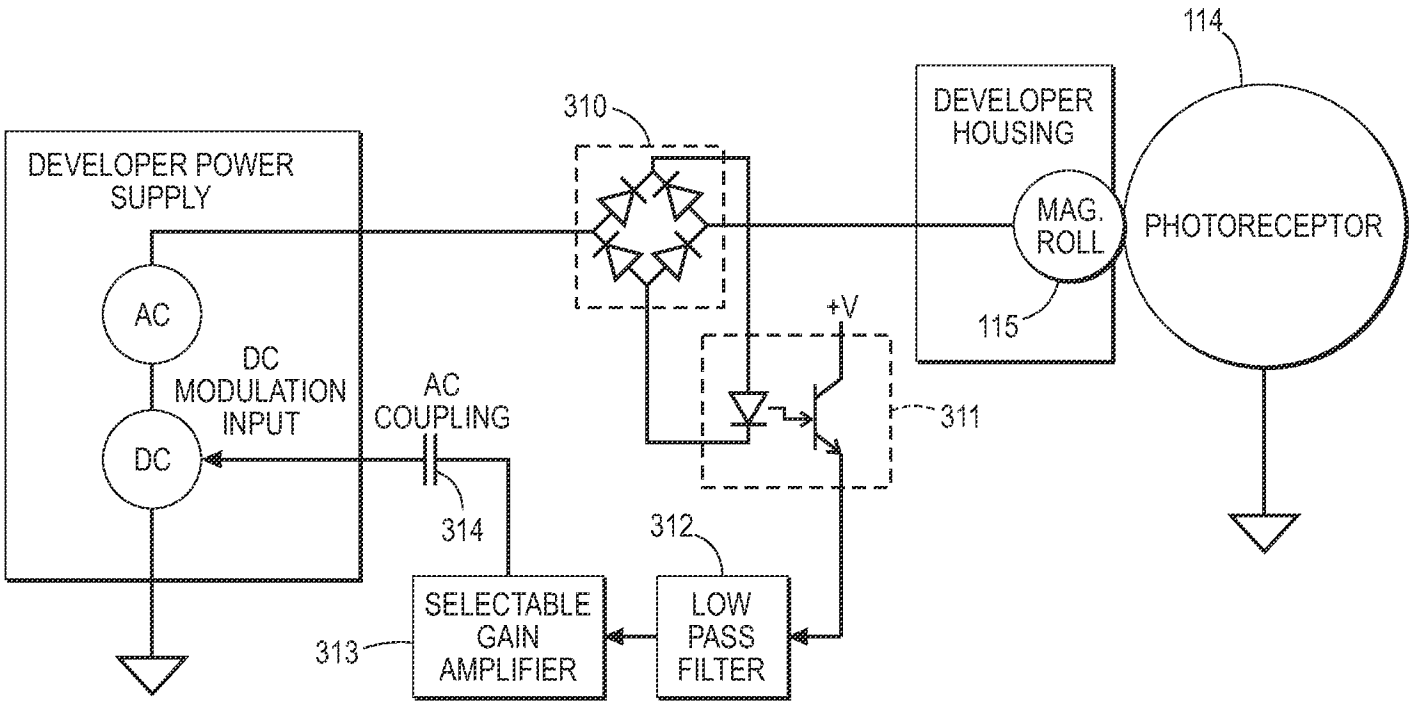
FIG. 7 shows electronic circuitry used to remove banding from images developed with the semi-conductive magnetic brush development in accordance with the present disclosure.

In practice, as shown in FIG. 7, the magnetic roll AC current on the developer bias line was measured in real-time during a print cycle as follows. The magnetic roll AC current was rectified through a full wave bridge 310 and passed through an analog opto-coupler 311 in order to measure the magnitude of the magnetic roll AC current. The latter signal was then filtered through low pass filter 312 to 100 Hz.

Figure 2:
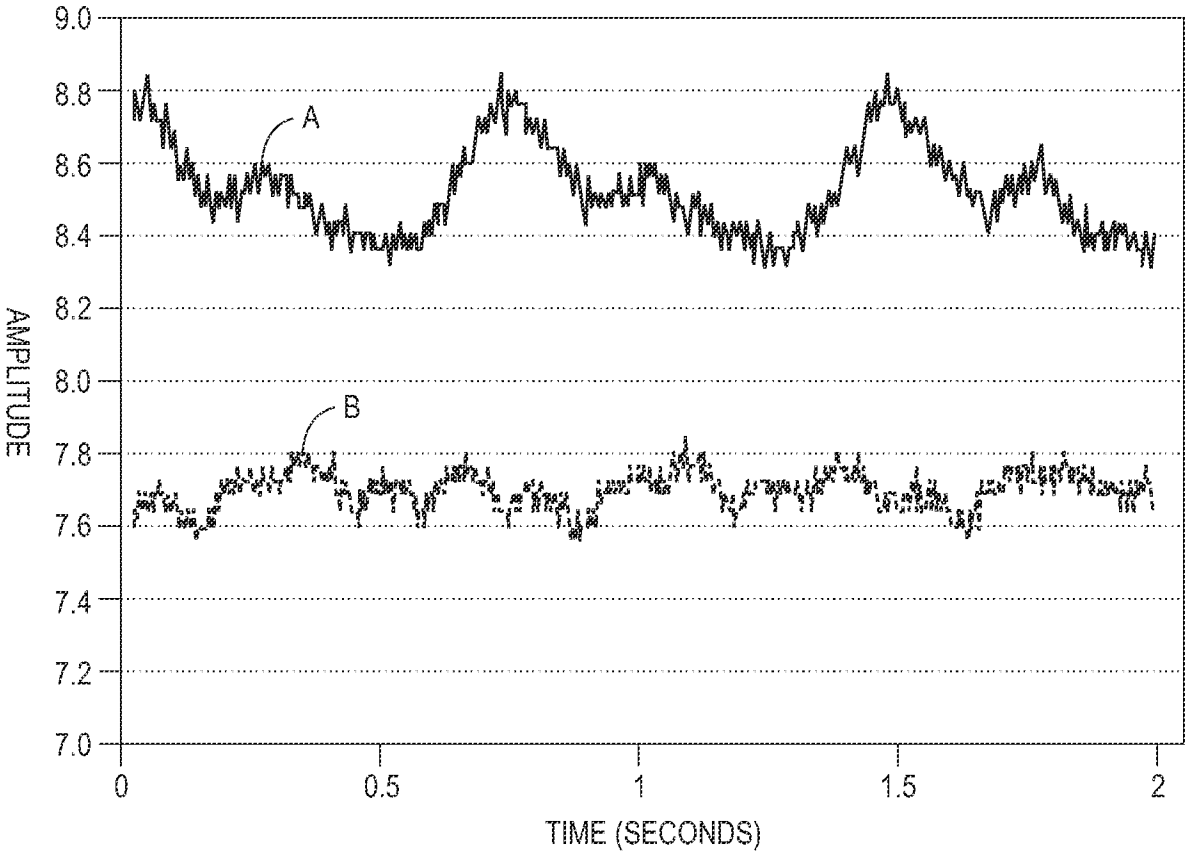
FIG. 2 is a chart showing magnetic roll AC current after full wave rectification and low pass filtering at 500 Hz.

The low pass filtered current signal 312 exemplified in FIG. 2 was then amplified at 313 and AC coupled at 314 into the magnetic developer DC power supply error amplifier. The AC couple 314 was used so as to not add a DC offset to the AC correction signal. The circuit generates a time varying correction voltage that is added to the DC bias on the developer power supply in phase with the AC current variation. In one test, where the nominal DC development voltage was 544V the correction voltages needed to cancel the banding was about 5Vp-p. The magnetic roll DC supply was measured to have a frequency response up to 50 Hz which is more than adequate for this and most applications since most corrections occur at less than 10 Hz. With further reference to FIG. 2, the lower curve B represents the AC current taken at 15k developer print life during a test of Fuji Xerox FC2 toner in a Xerox DC8000 printer, while the upper curve A shows the results taken at 40K into the test. Banding was not observed at 15K, but was observed at 40K. Thus, the current measurement is capable of discriminating the banding performance of the machine.

Figure 3:
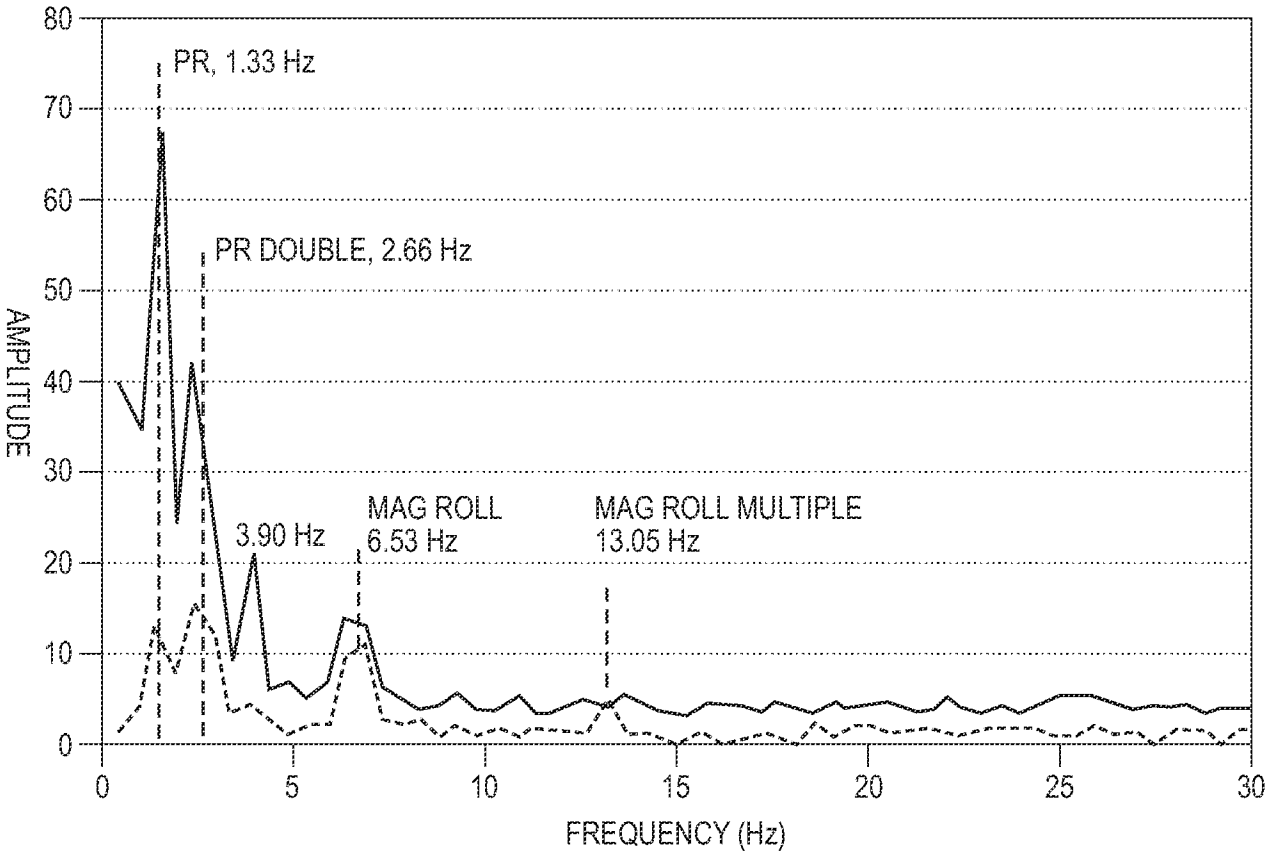
FIG. 3 is a chart showing the FFT of the AC current in FIG. 2.
Figure 4A:
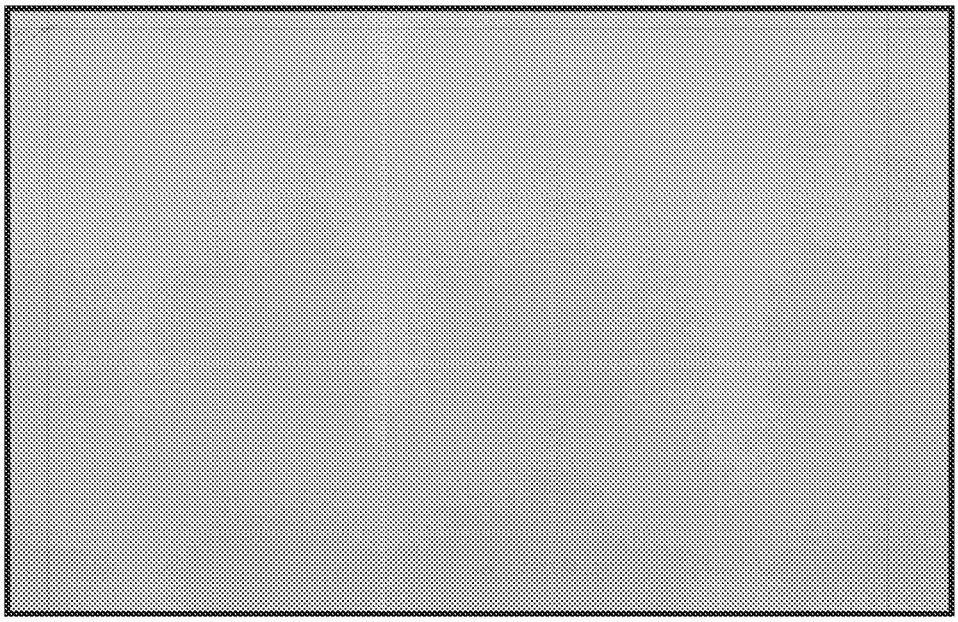
FIG. 4 shows scanned images of black halftones before and after electronic correction applied to DC developer voltage.
Figure 4B:
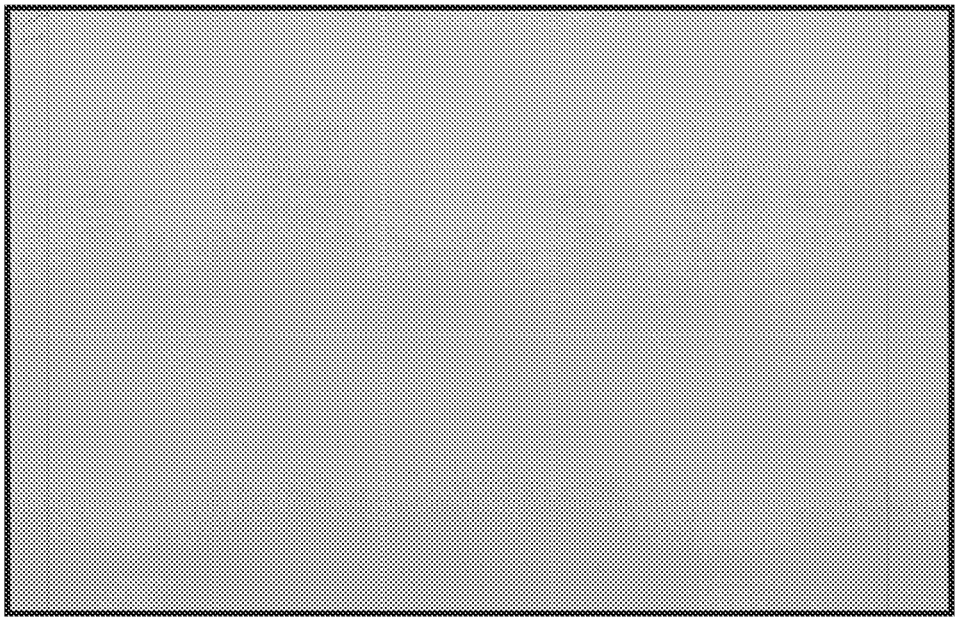
Figure 5:
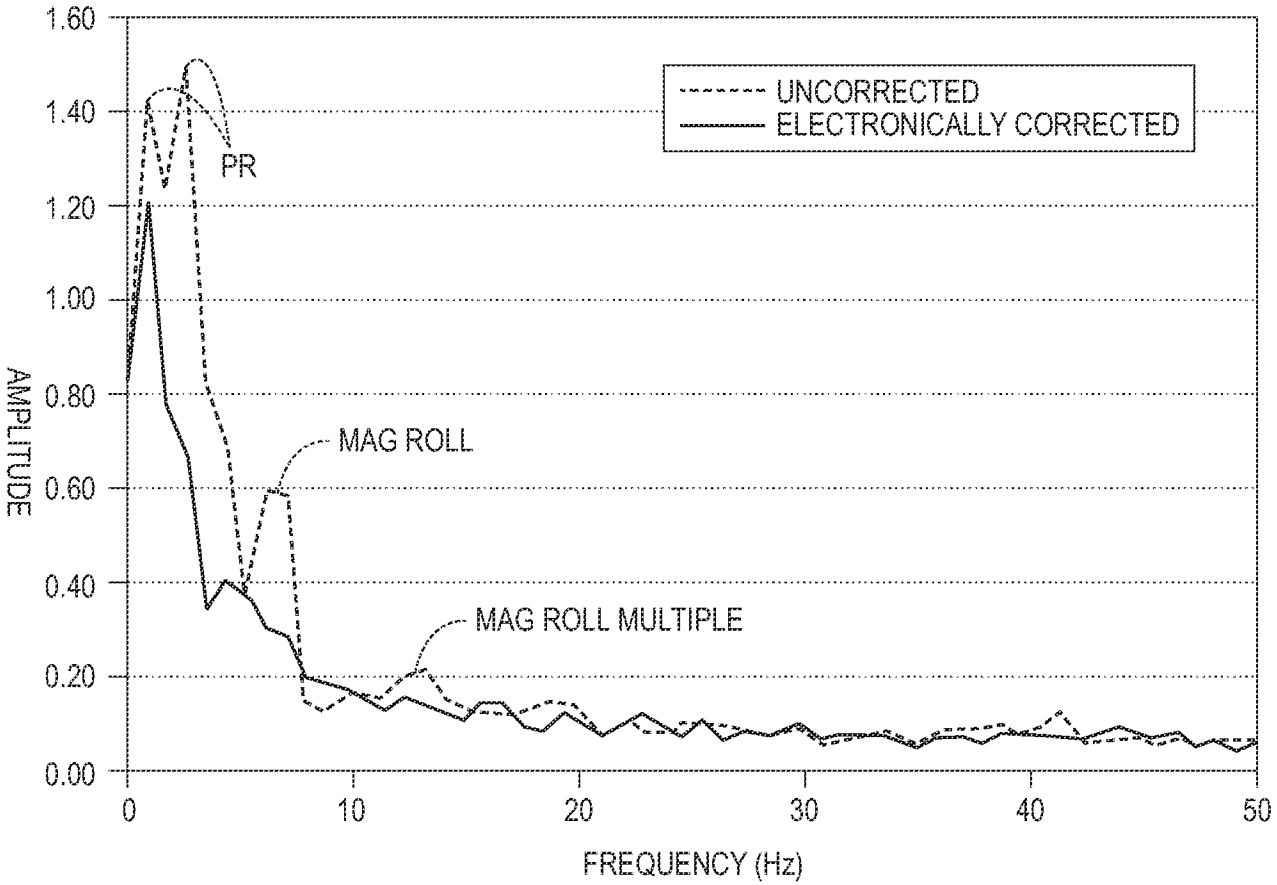
FIG. 5 shows banding FFT print scans.

The method detailed hereinbefore was used to actively correct or null out the banding frequency components below 50 Hz. FIG. 4 shows a digital scan of the corrected and uncorrected prints side by side indicating visually the magnitude of the correction achieved. FIG. 5 shows the banding FFT of the prints of FIG. 3. The FFT shows that the photoreceptor double and magnetic roll banding frequencies are eliminated from the halftones.

Figure 6:
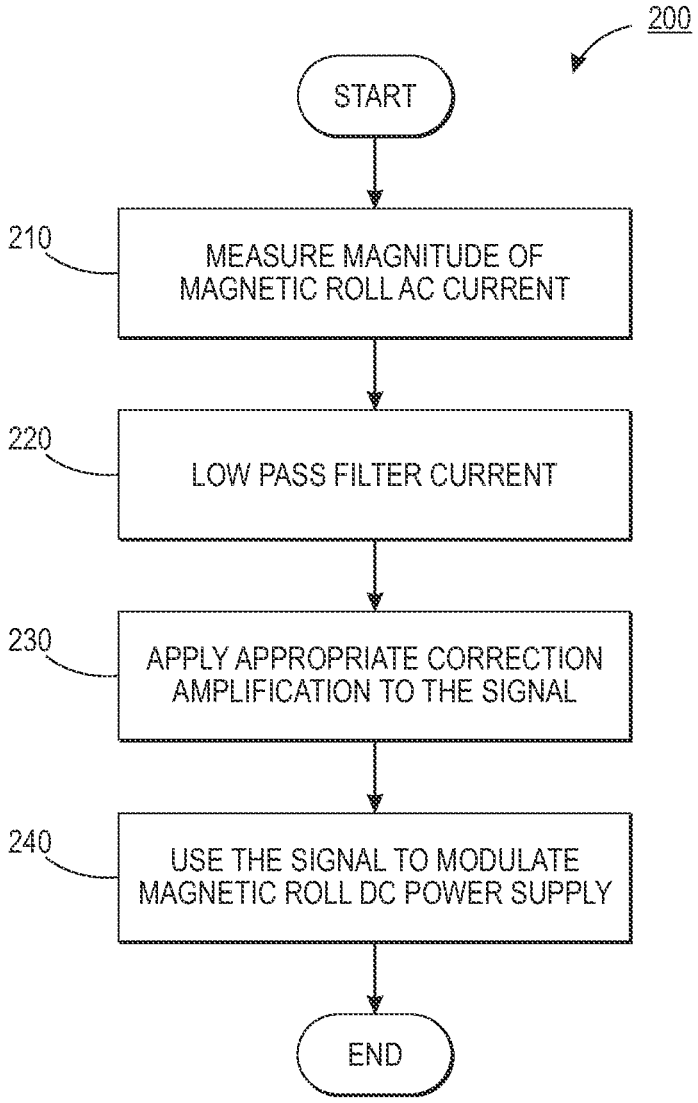
FIG. 6 shows an exemplary electronic development compensation method in accordance with an embodiment.

In recapitulation, an exemplary electronic development compensation method to actively correct or null out the banding frequency components in real-time below 50 Hz in xerographic marking engines based on SCMB development is shown in FIG. 6 as 200 and includes measuring the magnitude of the magnetic roll AC current in step 210. Next, in step 220, the signal is low pass filtered. Continuing to step 230, appropriate correction amplification is applied to the signal. In step 240, the signal is used to modulate magnetic roll DC power supply in phase with the AC current variation in step 210. These steps are performed in real-time during a print cycle.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for actively correcting banding frequency components below 50 Hz in xerographic marking engines that include a charge retentive substrate and semi-conductive magnetic brush development of images placed on said charge retentive substrate, comprising:

(a) providing a developer housing that includes developer therein;

(b) providing at least one magnetic roll in communication with and adapted to receive semi-conductive developer thereon from said developer housing;

(c) providing a developer power supply to apply a DC bias to said at least one magnetic roll;

(d) providing an AC voltage to said at least one magnetic roll;

(e) measuring the magnitude and filtering said at least one magnetic roll AC current;

(f) amplifying said filtered AC roll current signal;

(g) generating a time varying correction voltage; and (h) adding said correction voltage to said DC roll bias on said developer power supply.

2. The method of claim 1, including applying said correction voltage in phase with said measured AC current in (e).

3. The method of claim 1, wherein said filtered current signal in (e) is low pass filtered.

4. The method of claim 3, wherein said low pass filtered current signal is filtered to about 50 Hz.

5. The method of claim 1, wherein said measured AC current in (d) is rectified through a full wave bridge and passed through an analog opto-coupler.

6. The method of claim 1, including performing said method in (a) through (h) in real-time during a print cycle.

7. A method for removing banding from images developed with magnetic brush development, comprising:

providing a magnetic brush;

measuring the magnitude of and filtering an AC current to said magnetic brush;

amplifying said measured and filtered AC current signal;

providing a DC power supply for applying a DC bias to said magnetic brush;

coupling said amplified AC current signal into said DC power supply; and adding a correction voltage resulting from said coupling of said amplified AC current signal into said DC power supply to said magnetic brush bias to correct for banding.

8. The method of claim 7, including applying said correction voltage in phase with said measured AC current.

9. The method of claim 7, wherein said filtered current signal is low pass filtered.

10. The method of claim 9, wherein said low pass filtered current signal is filtered to about 50 Hz.

11. The method of claim 7, wherein said measured AC current is rectified through a full wave bridge and passed through an analog opto-coupler in order to measure the magnitude of said magnetic brush current.

12. The method of claim 7, including performing said method in real-time during a print cycle.

13. An electronic compensation method for actively correcting or nulling out banding frequency components in a reprographic engine employing a semi-conductive magnetic brush development device, comprising:

including at least one magnetic roll in said semi-conductive magnetic brush development device;

providing at least one magnetic roll AC current signal to said semi-conductive magnetic brush development device;

measuring the magnitude of and filtering said at least one magnetic roll AC current signal;

amplifying said AC filtered current signal;

providing a DC power supply to apply a DC bias to said semi-conductive magnetic brush development device;

providing a DC power supply error amplifier;

coupling said AC filtered current signal into said DC power supply error amplifier; and adding a correction voltage resulting from said coupling of said AC filtered current signal into said DC power supply error amplifier to said DC bias on said semi-conductive magnetic brush development device power supply.

14. The method of claim 13, wherein said filtered AC current signal is low pass filtered.

15. The method of claim 14, wherein said correction voltage is applied to said DC bias on said semi-conductive magnetic brush development device power supply in phase with AC current variation.

16. The method of claim 15, wherein said banding frequency components are below 50 Hz.

17. The method of claim 14, wherein said low pass filtered AC current signal is filtered to about 50 Hz.

* * * * *